United States Patent [19]

Putnam et al.

[11] Patent Number: 4,899,462

[45] Date of Patent: Feb. 13, 1990

[54] LINT BURNING CLOTHES DRYER

[75] Inventors: Brett J. Putnam, Ripon, Wis.; David H. McFadden, Lexington; William P. Dowst, Wakefield, both of Mass.

[73] Assignee: Speed Queen Company, Ripon, Wis.

[21] Appl. No.: 257,663

[22] Filed: Oct. 14, 1988

[51] Int. Cl.[4] ..... F26B 11/04

[52] U.S. Cl. ..... 34/19; 34/82; 34/133

[58] Field of Search ..... 34/79, 23, 35, 86, 131, 34/133, 77, 126, 82, 19; 432/112, 113, 108

[56] References Cited

U.S. PATENT DOCUMENTS 4,665,628 5/1987 Clawson .
4,669,199 6/1987 Clawson et al. .

*Primary Examiner*—Henry A. Bennet

*Attorney, Agent, or Firm*—William R. Clark; Richard M. Sharkansky

[57] ABSTRACT

A clothes dryer having a cylindrical lint screen connected to and extending from the rear of a rotating clothes drum having a perforated front annulus and a rear air inlet. An air duct has a mouth at one end positioned adjacent to the perforated annulus and a blower is connected to the opposite end. The blower creates an induced draft on a burner located adjacent to a portion of the lint screen by drawing air from the burner into the drum air inlet and out the perforated annulus into the duct. From the blower, the air is forced into a plenum which is separated into two compartments by the rotating lint screen filter. In passing from one compartment through the lint screen filter to the other compartment from which it is exhausted, airborne lint in the air is collected on the lint screen filter. Rotation of the lint screen filter moves the lint into the flames of the burner where the lint is incinerated.

10 Claims, 3 Drawing Sheets

LINT BURNING CLOTHES DRYER

BACKGROUND OF THE INVENTION

The field of the invention generally relates to clothes dryers, and more particularly relates to apparatus and method for circulating air through a clothes dryer and for collecting and incinerating lint in the air.

U.S. Pat. Nos. 4,665,628 and 4,669,199 disclosed a clothes dryer that had an axially-mounted fan that blew a high volume of air into the clothes drum from the rear. The entire length of the drum had perforations through which the large volume of air radially exited the drum. A substantially air-tight casing spacedly surrounded the drum thereby defining a circumferential recirculation passageway for the forced air to flow longitudinally to the rear. An annular lint screen was mounted to the drum and extended rearwardly therefrom. The flow path of the lint laden air was radially inwardly through the lint screen so that the airborne lint was deposited on the lint screen. A burner was positioned at one rotational location adjacent to the lint screen, and the lint screen rotated past the burner such that lint deposited around the entire circumference of the lint screen rotated through or close to the flames from the burner thereby incinerating the lint. According to a design objective of that dryer, a high percentage such as, for example, 90 percent of the air passing through the screen was then recirculated back into the drum by the fan. A second fan communicating with the air within the cylinder of the lint screen was used to exhaust a small percentage such as, for example, 10 percent, of the air.

The above-described clothes dryer had some drawbacks. First, the second fan was necessary in order to draw exhaust air positively from the high volume of air that was being forced into the drum and recirculated back around. Also, because the air was exhausted from the low pressure side of the fan inside the cylinder of the lint screen, close tolerance sealing was required to ensure that substantially all of the recirculating air passed through the lint screen thereby depositing airborne lint on the screen. In other words, if lint laden air were permitted to leak around the lint screen, the exhaust air would not have been lint free. Further, because of the location of the burner within the turbulent air flow of the high volume recirculation air, a power burner was used to provide optimum flame characteristics.

SUMMARY OF THE INVENTION

It is an object of the invention to provide improved apparatus and method for collecting and incinerating lint from a clothes dryer.

It is another object to provide a lint burning clothes dryer that only uses one blower for both exhausting and recirculating air. It is a further object to provide a lint burning clothes dryer where lint is effectively removed from the exhaust air using a rotating annular lint screen without a close-tolerance seal.

Another object of the invention is to provide a lint burning clothes dryer that uses an induced draft burner.

Still another object is to provide a lint burning clothes dryer that draws air from a perforated annulus in the drum via a longitudinal duct communicating with an arcuate suction mouth positioned adjacent to the rotating perforated annulus.

It is another object to provide a clothes dryer having a rotating lint screen which collects lint at one location on the high pressure side of a blower and rotates the lint on the screen to a burner positioned at a second location where the flames from the burner incinerate the lint.

In accordance with the invention, a clothes dryer is provided which comprises a clothes drum having perforations, a substantially cylindrical lint screen extending axially from the drum, a blower having an inlet coupled to the perforations for drawing air through the drum, means for directing output air from the blower through the screen to collect lint from the air onto the screen, and means for burning the lint on the lint screen. It is preferable that the dryer further comprise means for axially rotating the lint screen. Also, it is preferable that the burning means be stationary and that the lint screen rotate past the stationary burning means. Further, it is preferable that the directing means comprise a plenum having a first compartment on the outside of the lint screen and a second compartment with an exhaust port on the inside of the screen with the two compartments openly facing each other so that air directed from the first compartment through the lint screen to the exhaust port in the second compartment is filtered by the lint screen. It is also preferable that a duct be used to couple the blower to the drum perforations for drawing air from the drum.

The invention may also be practiced by the method of providing a clothes drum with a perforated front annulus and a rear inlet, positioning an annular lint screen filter at the rear of the drum, locating a stationary burner adjacent to a portion of the lint screen filter, positioning a duct adjacent to a portion of the perforated annulus, locating clothes to be dried in the clothes drum, drawing combustion air from the burner into the drum air inlet over the clothes and out the perforated annulus into the duct, forcing the air from the duct through the lint screen filter to an exhaust port, and rotating the lint screen filter so that lint collected from the air onto the lint screen filter is rotated to the burner for incineration.

BRIEF DESCRIPTION OF THE DRAWINGS

The foregoing objects and advantages will be more fully understood by reading the Description of the Preferred Embodiment with reference to the drawings wherein.

DESCRIPTION OF THE PREFERRED EMBODIMENT

Figure 1:
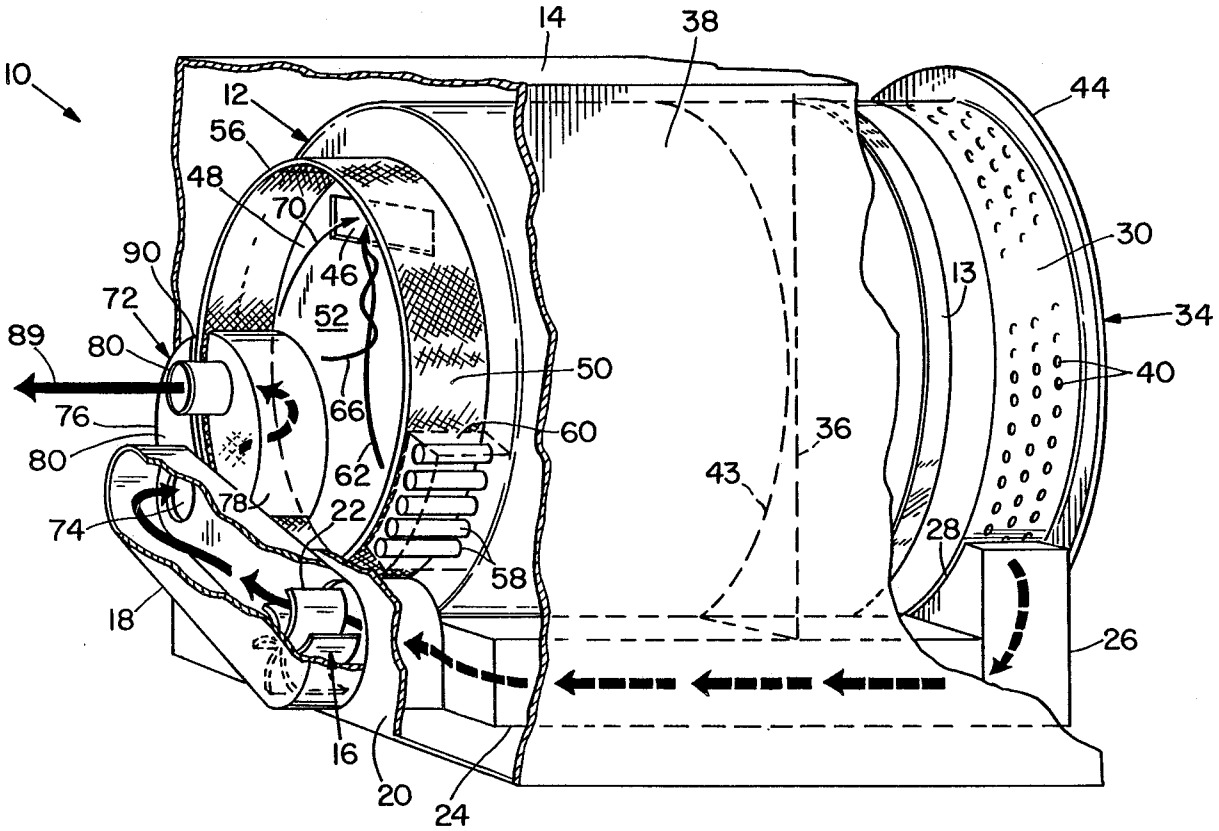
FIG. 1 is a partially broken away rear perspective view of a commercial clothes dryer embodying the invention.

Now, referring generally to the drawings where like reference designations refer to like or similar parts throughout the several views, a clothes dryer 10 includes a clothes drum 12 having perforations 40 circumferentially around a front annulus 30. A blower 16 draws air from perforations 40 via a duct 24 which has a mouth 28 which is spacedly positioned adjacent to a portion of annulus 30. Even though drum 12 is rotated, some of perforations 40 are always adjacent to mouth 28 such that air is constantly being drawn from drum 12. The air from blower 16 is forced into one side or compartment 84 of plenum 72 from where it flows under pressure through lint screen 50 to the other side or compartment 86. The air is exhausted through exhaust port 88. The lint in the air is collected on lint screen 50 within plenum 72 and is then rotated on screen 50 over to burners 58 where it is incinerated. There is a clearance seal 90 between lint screen 50 and the segments 76 and 78 of plenum 72, but it does not need to be close tolerance because leakage air is drawn back into drum inlet 46 as recirculation air 70 rather than being exhausted. In other words, the exhaust air 89 is substantially free of lint even though air may leak from plenum 72 without passing through the portion of lint screen 50 that passes through plenum 72.

Figure 3:
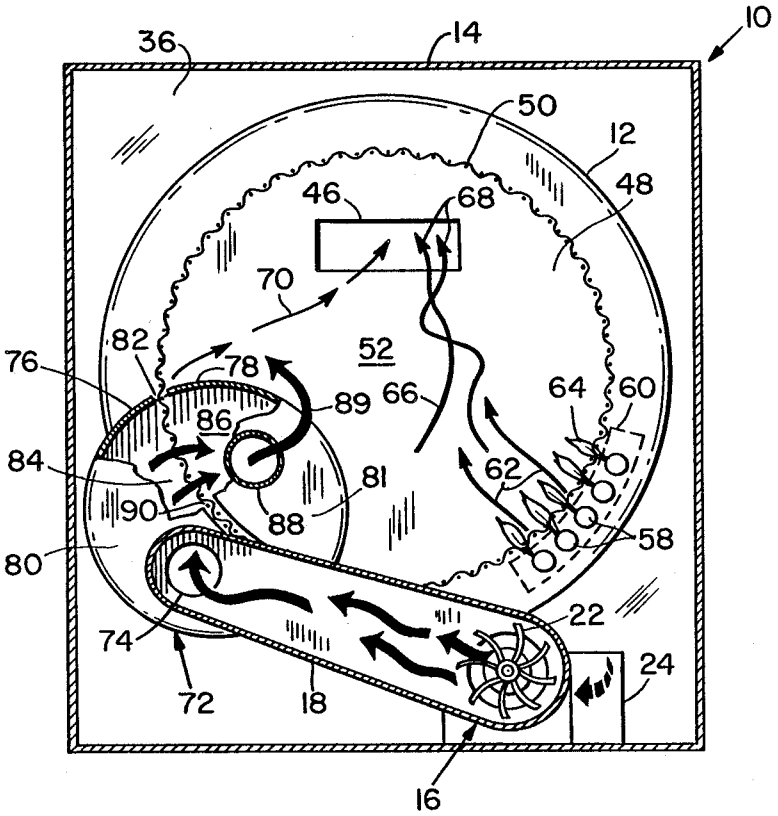
FIG. 3 is a sectioned rear view of the clothes dryer.

Now, referring specifically to FIG. 1, a partially broken-away rear perspective view of commercial gas operated clothes dryer 10 shows tumbler drum 12 located within dryer box 14 or outer casing. In conventional manner, clothes are inserted in tumbler drum 12 through a door (not shown) at the front, and then tumbler drum 12 is axially rotated by suitable means such as belt 13 driven by motor 15 (FIG. 2) while hot drying air is circulated through tumbler drum 12. The circulation of air is effected by blower 16 which is located within blower shroud 18 which is positioned behind the outside rear wall 20 of dryer box 14. More specifically, blower 16, which is also shown in FIG. 3, is rotated by suitable drive means and the blades 22 force air laterally through blower shroud 18. Air is drawn to blower 16 from tumbler drum exhaust duct 24 which communicates at the back with blower shroud 18. Exhaust duct 24 extends longitudinally forward along the underside of tumbler drum 12 and communicates with suction duct 26 or chamber at the front of drum 12.

Figure 2:
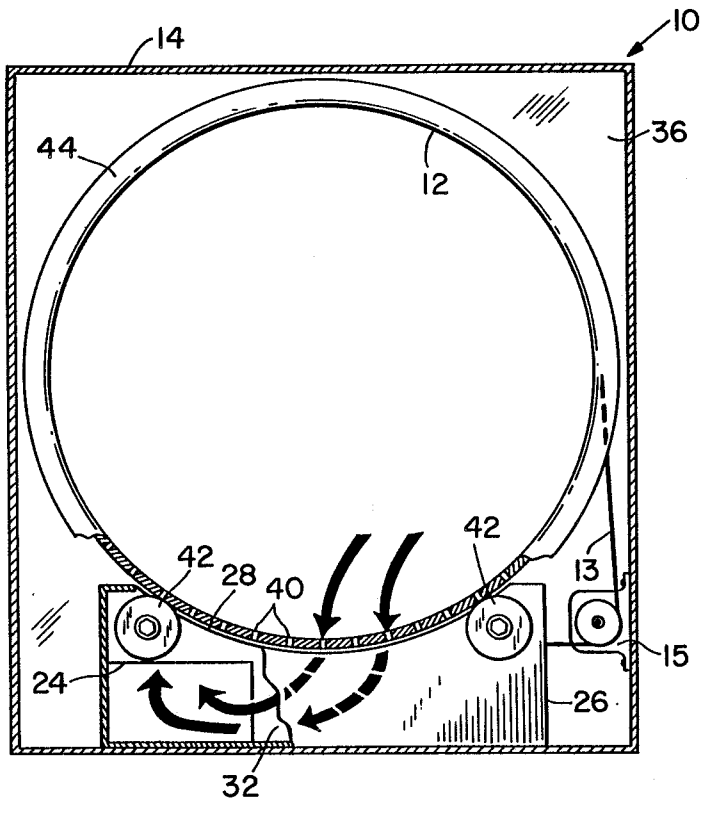
FIG. 2 is a sectioned front view of the clothes dryer.

Now referring also to FIG. 2, suction duct 26 has an arcuate top opening 28 or mouth that conforms with and is positioned in close spaced relationship with a perforated annulus 30 of tumbler drum 12. Suction duct 26 has a hollow cavity 32 that communicates with exhaust duct 24 such that air drawn from cavity 32 by blower 16 into exhaust duct 24 creates a slightly negative pressure along an arcuate section of the perforated annulus 30 adjacent to opening 28. The front 34 of dryer box 14 is substantially sealed by the door, and a partition 36 substantially seals the mid-portion 38 of tumbler drum 12 to dryer box 14 such that most of the air being drawn or sucked into opening 28 derives or is drawn from the interior of tumbler drum 12 through perforations 40 which are instantaneously situated adjacent thereto. More specifically, even though tumbler drum 12 rotates, there are perforations 40 around the entire circumference of perforated annulus 30 such that in all rotational orientations of tumbler drum 12, there are perforations 40 which are closely adjacent to the opening 28 or mouth of suction duct 26 so that air is continuously drawn from tumbler drum 12. As shown in FIG. 2, rollers 42 are provided to support the front 34 of tumbler drum 12 as motor 15 drives belt 13 to rotate tumbler drum 12. Partition 36 is generally a panel that is affixed to dryer box 14 around the outside and has an interior circular aperture 43 through which tumbler drum 12 longitudinally extends. Preferably, a suitable slip gasket may be provided to seal drum 12 to partition 36 so as to increase the suction by which suction duct 26 draws air from the interior of tumbler drum 12. A flange 44 is attached to the front 34 of tumbler drum 12.

Still referring to FIG. 1 and also to FIG. 3, the air being sucked or drawn outwardly through perforations 40 by suction duct 26 is replaced by air being drawn inwardly through drum inlet 46 that here is a rectangular port at the top of back stationary wall 48 which covers the rear of tumbler drum 12. A cylindrical stainless steel lint screen 50 or filter surrounds a central rear region 52 behind tumbler drum 12. Although wall 48 is stationary, lint screen 50 is connected or coupled to tumbler drum 12 such that it rotates with tumbler drum 12. The rear edge 56 of lint screen 50 seals to the rear wall 20 of dryer box 14 by seating against a running surface (not shown) of the rear wall.

Air is drawn by blower 16 into drum inlet 46 along three general paths. First, a plurality of tubular gas burners 58 are axially positioned in an arc within burner box 60 along an outside sector of lint screen 50 as shown. A gaseous fuel including primary air is introduced by suitable means into tubular burners 58, and burner box 60 communicates with a vent (not shown) in the rear wall 20 through which secondary combustion air is drawn. In operation, the flow of air into drum inlet 46 draws combustion products 62 from burner box 60 thereby operating burners 58 in induced draft. The flames 64 from burners 58 fire onto rotating lint screen 50 thereby incinerating lint as will be described later herein.

The second path for air into drum inlet 46 is through inlet ports (not shown) in the rear wall 20 of dryer box 14 outside the circumference of lint screen 50. This fresh air 66 mixes with the combustion products from burners 58 as shown best in FIG. 3 thereby limiting the temperature at which air enters drum inlet 46. More specifically, burners 58 are located towards the bottom of region 52, and drum inlet 46 is located towards the top of region 52 such that there is adequate mixing length for combustion products 62 and fresh air 66 thereby providing inlet air 68 having a limited uniform temperature. The ratio of mixing air is selected so as to provide a suitable temperature.

The third path for air into drum inlet 46 is recirculation air 70 leaked from plenum 72. More specifically, referring to FIGS. 1 and 3, blower 16 forces air from tumbler drum exhaust duct 24 laterally through blower shroud 18 which has an exit port 74 into plenum 72. Blower shroud 18 is outside of rear wall 20 and plenum 72 is inside, so the exhaust air flows axially inward through exhaust port 74 into plenum 72. As shown best in FIG. 3, plenum 72 is an enclosure which includes two arcuate or semi-circular segments 76 and 78 each having a respective cover 80 and 81. Segments 76 and 78 and covers 80 and 81 are slightly spaced defining a gap 82 through which annular lint screen 50 rotates with the lint screen extending outwardly from or above covers 80 and 81. Stated differently, segment 76 is stationarily positioned on the outside of lint screen 50 defining a first compartment 84 or cavity, and segment 78 is stationarily positioned in region 52 on the inside of lint screen 50 thereby defining a second compartment 86 or cavity. Compartments 84 and 86 openly face each other. The air from blower shroud 18 enters first compartment 84 on the outside of lint screen 50 through exit port 74. Such air is lint laden and, under positive pressure, it flows through lint screen 50 into second compartment 86 on the inside of lint screen 50. The airborne lint is deposited or collected on the outside of lint screen 50 as it rotates through gaps 82. Air exits second compartment 86 of plenum 72 through exhaust port 88 which conveys the exhaust air 89 through rear wall 20. There is a clearance seal 90 between segments 76 and 78 and lint screen 50, so some air leaks from plenum 72 without entering second compartment 86. A close tolerance seal is not required because this leakage air is within box 14 and is drawn into drum inlet 46 thereby providing recirculation air 70 for dryer 10. Preferably, recirculation air 70 may comprise approximately 20 percent of the air entering drum inlet 46. Plenum 72 is so arranged, however, that air forced into segment 78 for exhaust through exhaust port 88 has passed through lint screen 50 thereby removing airborne lint. The lint collected on lint screen 50 within plenum 72 is then conveyed on the rotating lint screen over to flames 64 of burners 58 where the lint is incinerated.

Figure 4:
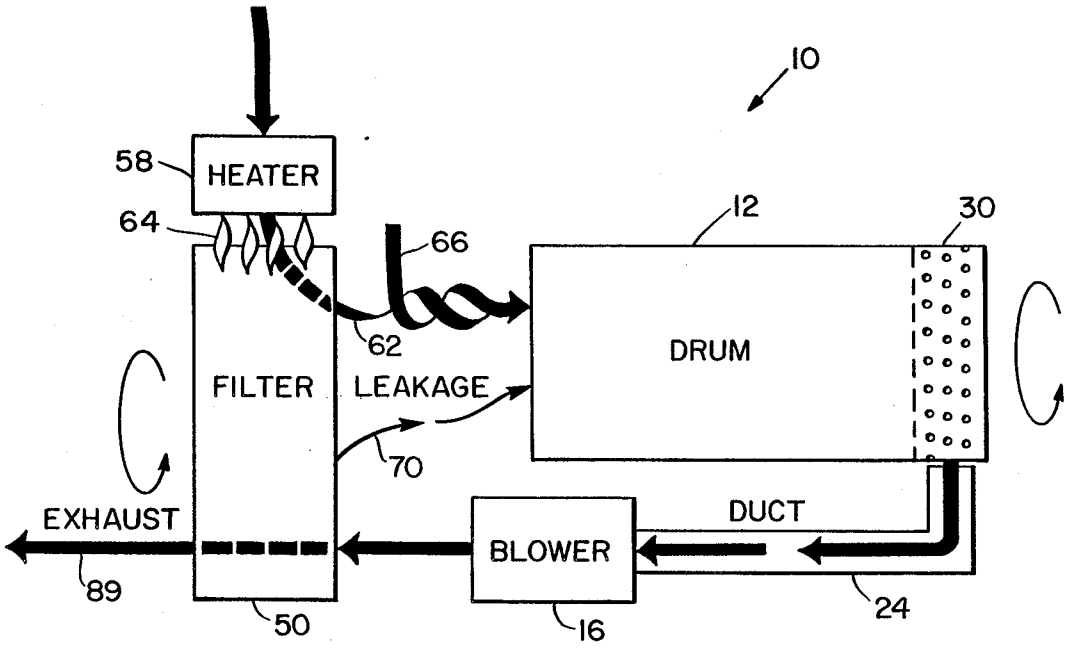
FIG. 4 is a diagrammatical view of the air flow through the clothes dryer.

Referring to FIG. 4, a diagrammatical view of the air flow system of dryer 10 is shown. Blower 16 draws air from the perforated annulus 30 of drum 12 via duct 24, and the air is exhausted through filter 50 where the airborne lint is collected. The sucking of air from the perforated annulus 30 of drum 12 draws air from three different sources into the back of drum 12. First, there are combustion products 62 that are drawn from the heater, here burner 58, which operates in an induced draft. Second, there is fresh air 66 which mixes with and thereby cools the combustion products 62 to a suitable uniform temperature before being drawn into drum 12. Third, there is leakage air 70 from filter 50 which recirculates through drum 12, and, for example, comprises 20 percent of the air input through the drum inlet. The lint screen 50 or filter rotates with drum 12 such that lint collected from the exhaust air is rotated around to the heater flames 64 where it is incinerated.

In accordance with the invention, blower 16 is upstream from lint screen 50 or, stated differently, the lint filter is on the high pressure side of blower 16. Further, the blower 16 is at the outlet of the tumbler drum 12. Accordingly, the air passing through the lint filter 50 is pressurized such that there is no requirement for a second blower—one to recirculate and one to exhaust. Also, it is not necessary for clearance seal 90 between lint screen 50 and covers 80 and 81 to be of close tolerance because substantially all of the air that goes into second compartment 86 flows through lint screen 50 before being exhausted through exhaust port 88. Accordingly, exhaust air 89 is substantially lint-free. On the other hand, any air that leaks through clearance seal 90 without having the lint removed by lint screen 50 is retained within dryer box 14 and is drawn into drum inlet 46 as recirculation air. Accordingly, lint is effectively removed from the exhaust air, and air that leaks from the filtering process is enclosed by dryer box 14 and drawn back into tumbler drum 12 through drum inlet 46 as recirculation air. In other words, the exhaust air 89 is suitably filtered by lint screen 50 at a localized region within plenum 72 without the requirement of having a close tolerance seal to ensure that all air exiting drum 12 is passed through lint screen 50. The leakage air is not exhausted, but rather is recirculated through drum 12.

This concludes the Description of the Preferred Embodiment. A reading of it by those skilled in the art will bring to mind many alterations and modifications without departing from the spirit and scope of the invention. Accordingly, it is intended that the scope of the invention be limited only by the appended claims.

What is claimed is:

1. A clothes dryer comprising:

a clothes drum having perforations;

a substantially cylindrical lint screen extending axially from said drum;

a blower having an inlet and an outlet, said blower being connected between said perforations and said lint screen with said inlet being coupled to said perforations and said outlet being directed to said lint screen wherein air is drawn by negative pressure from said drum through said perforations and then passes through said blower before being directed through said lint screen such that lint in said air is collected on the high pressure blower side of said lint screen; and means for burning said lint on said lint screen.

2. The dryer recited in claim 1 further comprising means for axially rotating said lint screen.

3. The clothes dryer recited in claim 2 wherein said burning means is stationary and said lint screen rotates past said stationary burning means.

4. The dryer recited in claim 3 wherein said cylindrical lint screen has an inside and an outside, said dryer further comprising a plenum having a first compartment on the outside of said lint screen and a second compartment with an exhaust port on the inside of said screen, said air being directed from said first compartment through said lint screen to said exhaust port in said second compartment.

5. The dryer recited in claim 4 wherein said perforations are located in a front annulus of said drum, said dryer further comprising a duct coupled between said annulus and said blower.

6. A clothes dryer comprising:

a clothes drum having a front perforated annulus;

an annular lint screen filter coupled to said drum and extending axially rearwardly therefrom;

means for axially rotating said drum and said lint screen filter;

a blower having an inlet and an outlet;

a duct having one end communicating with said inlet of said blower and an opposite end spaced adjacent to at least a portion of said perforated annulus for drawing air from said drum;

a dryer exhaust port;

means for directing air from said blower outlet through said lint screen filter to said exhaust port;

a stationary burner positioned adjacent to a portion of said lint screen filter wherein lint collected on said screen filter is rotated on said screen filter past said burner for incineration.

7. The dryer recited in claim 6 wherein said directing means comprises an enclosure divided into first and second compartments by said lint screen filter which rotates therethrough, said air from said burner outlet being forced into said first compartment and flowing through said lint screen filter to said second compartment before passage to said exhaust port.

8. The dryer recited in claim 6 further comprising an air inlet at the rear of said drum, said blower providing an induced draft on said burner by drawing air from said burner into said drum inlet through said drum and out said perforated annulus.

9. The method of drying clothes in a clothes dryer having a clothes drum with a perforated front annulus and a rear air inlet, the dryer further having an annular lint screen filter at the rear of the drum and a stationary burner adjacent to a portion of the lint screen filter, comprising the steps of:

positioning clothes in the clothes drum;

activating the burner;

rotating the clothes dryer and the lint screen filter;

providing a negative pressure outside the perforations so as to draw air into the drum through the rear air inlet and out through the perforations;

pressurizing air drawn from the perforations in a blower and directing the air under positive pressure radially inwardly through the lint screen filter; and exhausting at least a portion of the air that is directed radially inwardly through the lint screen filter.

10. A clothes dryer comprising:

a clothes drum having perforations;

a substantially cylindrical lint screen extending axially from said drum;

a burner positioned adjacent said lint screen;

means for rotation said clothes drum and said lint screen; and means for providing a negative pressure in said drum wherein air is drawn into said rear air inlet past said burner, said providing means comprising a blower having an inlet coupled to said perforations whereby air is drawn from said drum, said blower having a high pressure outlet directing air radially inwardly through said lint screen, wherein lint in said air is collected on the high pressure side of the lint screen, said lint being rotated on said lint screen around to said burner for incineration.

* * * * *